US005975010A

United States Patent [19]

Marshall

[11] Patent Number: 5,975,010

[45] **Date of Patent: *Nov. 2, 1999**

[54] INDICATOR

[76] Inventor: Forrest A. Marshall, P.O. Box 649, Dublin, Ga. 31021

[ * ] Notice: This patent issued on a continued prosecution application filed under 37 CFR 1.53(d), and is subject to the twenty year patent term provisions of 35 U.S.C. 154(a)(2).

This patent is subject to a terminal disclaimer.

[21] Appl. No.: 08/986,538

[22] Filed: Dec. 8, 1997

Related U.S. Application Data

[63] Continuation of application No. 08/380,598, Jan. 30, 1995, Pat. No. 5,694,882.

[51] Int. Cl.[6] ..... G09F 9/00

[52] U.S. Cl. ..... 116/315; 116/311; 116/319

[58] Field of Search ..... 116/297, 306, 116/308, 309, 311, 315, 319, 320

[56] References Cited

U.S. PATENT DOCUMENTS

| | | | |
|---|---|---|---|
| 387,192 | 7/1888 | Velie . | |
| 398,012 | 2/1889 | Weaver | 116/308 |
| 557,616 | 4/1896 | Scott . | |
| 579,474 | 3/1897 | DeBarry . | |
| 596,646 | 1/1898 | Altshul . | |
| 692,166 | 1/1902 | Schaffer . | |
| 710,708 | 10/1902 | McShane . | |
| 1,594,675 | 8/1926 | Kuhlman . | |
| 2,518,907 | 8/1950 | Konwal . | |
| 2,587,147 | 2/1952 | Guion et al. | 116/308 |
| 2,595,980 | 5/1952 | Neubauer et al. . | |
| 2,713,845 | 7/1955 | Silverman . | |
| 3,032,003 | 5/1962 | Lambert et al. . | |
| 3,921,568 | 11/1975 | Fish . | |
| 4,011,829 | 3/1977 | Wachsmann et al. . | |
| 4,511,050 | 4/1985 | Nicol . | |
| 4,951,596 | 8/1990 | Wallace, Jr. . | |
| 5,115,929 | 5/1992 | Buono . | |
| 5,216,975 | 6/1993 | Bartholomew . | |
| 5,271,353 | 12/1993 | Besthorne . | |
| 5,279,422 | 1/1994 | Adams . | |
| 5,331,919 | 7/1994 | Root et al. . | |
| 5,356,012 | 10/1994 | Tang et al. . | |
| 5,694,882 | 12/1997 | Marshall | 116/311 |

*Primary Examiner*—Michael Brock
*Assistant Examiner*—Willie Morris Worth
*Attorney, Agent, or Firm*—Dean W. Russell; Kilpatrick Stockton LLP

[57] ABSTRACT

Indicators and methods of indicating are disclosed. Intended primarily for use with medicine containers, the devices typically indicate the number of doses of medication ingested or remaining to be taken by a patient during a particular period. These devices additionally provide tactile assistance to patients in appropriately repositioning the indicator arms and, when used correctly, may reduce the possibility of patient overdose by restricting improper attempts to advance the indicator arm.

5 Claims, 2 Drawing Sheets

INDICATOR

This application is a Continuation of and claims priority to U.S. application Ser. No. 08/380,598, filed Jan. 30, 1995, now U.S. Pat. No. 5,694,882.

FIELD OF THE INVENTION

This invention relates to an indicator and more particularly to a mechanism permitting a patient to determine the number of doses of medicine taken or remaining to be ingested in a designated interval.

BACKGROUND OF THE INVENTION

Physicians often prescribe medications requiring periodic ingestion by a patient. Products sold to patients over-the-counter, or without a practitioner's prescription, similarly typically mandate regular intake for optimal performance. Complying with these requirements necessitates that each patient recollect that doses of the medication previously were taken, as failure to do so may result in ingestion of more or less than the specified dosage during a particular period.

Many patients, however, are unable to remember or determine the amount of medication already taken over a given duration. This is especially true of certain elderly patients, who may experience short-term memory loss or, because their infirmities require ingestion of substantial numbers of different medications, confuse the dosage previously taken of each. Empirical evidence suggests that elderly glaucoma patients in particular are plagued by these problems. Combined with their decreased abilities to view the medication containers themselves, these glaucoma patients often have no means of determining whether they have taken the mandated doses.

The concept of using indicators or "medicine minders" has existed for many years. U.S. Pat. No. 710,708 to Mcshane, for example, describes at lines 8–13 a medicine bottle having > a scale of the full, half and quarter hours from 12 to 11.45 o'clock, together with an indicator to indicate the time of taking the medicine therein contained.

A side of the specially-molded bottle contains a "flat-topped ridge" on which a time scale is printed and having grooves to receive the "gripping claws" of an indicator. The patient is instructed to move the indicator after each dose of medication is taken, positioning its index at the point on the scale corresponding to the time for taking the next dosage. The bottle does not indicate the number of doses either taken or remaining to be taken in a particular interval, however, thus neither preventing nor inhibiting overdoses. It further fails to assist glaucoma and other patients with poor (or no) vision in appropriately positioning the indicator after ingesting each dose.

More recently, U.S. Pat. No. 5,271,353 to Besthorne issued describing a medicine reminder device in which a housing having a clock face is attached, using an elastic band, to the cylindrical body of a medicine container. Mounted to the clock face are hour and minute hands. After taking medicine from the container, the patient resets the hands to indicate the time of the next dose. As with the medicine bottle of the McShane patent, however, the reminder device of the Besthorne patent provides no indication of the doses taken or to be taken. Likewise, it furnish patients no tactile or other non-visual assistance in appropriately repositioning the hands of the clock.

U.S. Pat. No. 4,511,050 to Nicol provides yet another type of dose indicator. Embodied in a two-piece cap, the indicator includes on one piece an embossed arrow or pointer and on the other graduated indicia. The cap is useful solely with threaded containers, however, and fails to indicate to the patient that the maximum doses have been taken during any given period.

SUMMARY OF THE INVENTION

The present invention provides a device responsive to many of these and other drawbacks of existing indicators. Unlike those discussed above, the present invention not only provides tactile assistance to patients in appropriately repositioning its indicator arm, but also is useful with a wide variety of medicine or other containers. When used correctly, moreover, the indicator of the present invention reduces the possibility of patient overdose by restricting further (improper) movement of the indicator arm.

In one embodiment of the present invention, the dose indicator is a molded plastic disc to which an indicator arm is connected. Affixed to the underside of the disc is a pressure-sensitive adhesive, allowing the disc to be attached to at least one surface of virtually all existing commercial medicine containers. When used with cylindrical bottles or containers having substantial curvatures, for example, such a disc may be attached to the (generally flat) upper surface of the cap of the container. For other containers, alternatively, the discs may be affixed to their front or rear faces or sides.

Embossed on the upper surface of the disc are indicia, typically numbers corresponding to doses of medicine intended for consumption by the patient. An annulus in the moveable indicator arm is designed to engage each embossed area, providing a positive (tactile) fit for the arm for each incremental dose. Additionally protruding above the upper surface are two pins or other projections which limit travel or placement of the indicator arm. One pin, whose location may be fixed for all discs, prevents the patient from attempting to place the arm outside its intended range of travel. The location of the other pin may vary, however, depending on the number of doses of medication the patient is prescribed in a particular interval (e.g. per twenty-four hours). Designed to be inserted (usually by the pharmacist) into one of a series of recesses in the disc and effectively locked into place, this pin prevents the indicator arm from travelling beyond an indicium corresponding to the maximum dose the patient is prescribed in the designated interval. As a result, it inhibits overdosing when the device is used properly by preventing the patient from advancing the arm after the final prescribed dose is taken.

Other embodiments of the invention may comprise separate caps or collars for placement about irregularly-shaped objects such as medicine droppers. Such devices may be adapted to provide more regular surfaces onto which discs may be affixed. Alternatively, other structures, including arches, may be utilized consistent with the present invention.

It is therefore an object of the present invention to provide an indicator furnishing tactile assistance to patients with poor or no vision (or operating in darkness).

It is another object of the present invention to provide an indicator that, when used correctly, may reduce the possibility of patient overdose.

It is also an object of the present invention to provide an indicator adapted to be affixed to surfaces of numerous containers.

It is a further object of the present invention to provide a disc having a moveable indicator arm that may engage a raised area of the disc to provide a positive, secure fit.

It is an additional object of the present invention to provide mechanisms limiting the range of movement of the indicator arm.

It is yet another object of the present invention to provide at least one such mechanism whose location depends on the number of doses or medicine to be taken by a patient during a particular interval.

Other objects, features, and advantages of the present invention will become apparent with reference to the remainder of the written portion and the drawings of this application.

DETAILED DESCRIPTION

Figure 1:
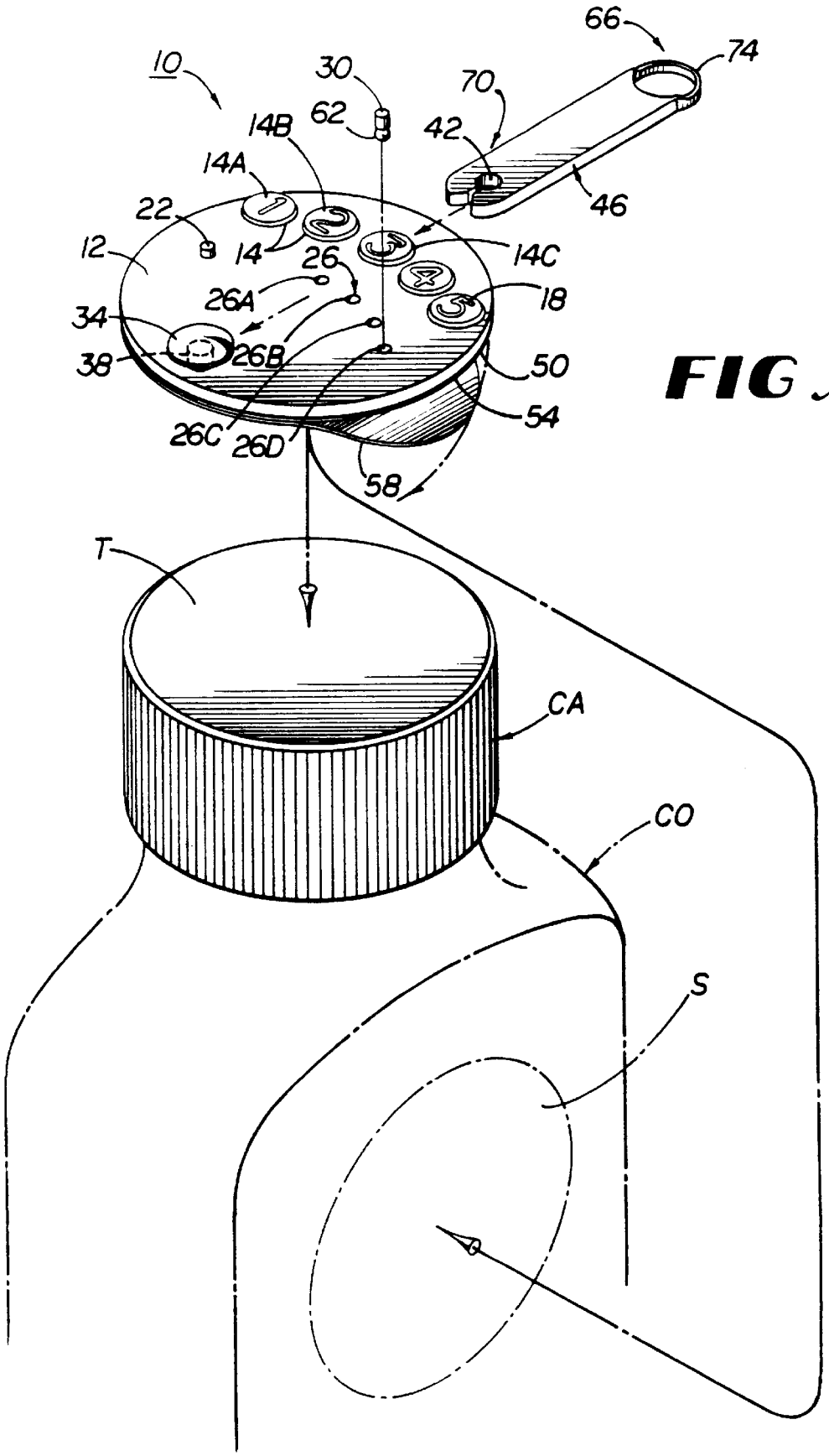
FIG. 1 is a partially-exploded perspective view of an exemplary indicator of the present invention shown prior to attachment to a bottle.
Figure 2:
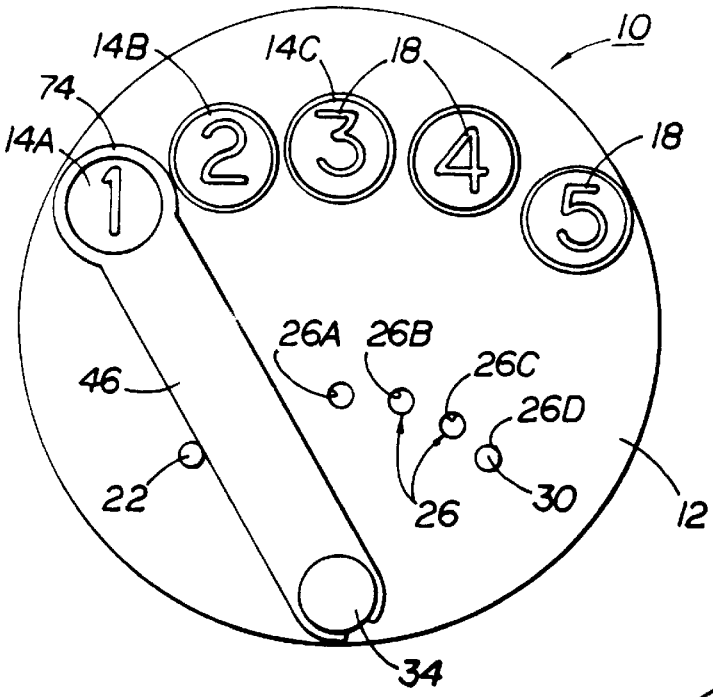
FIG. 2 is a top plan view of the indicator of FIG. 1.

FIGS. 1–2 illustrate indicator 10 of the present invention. As shown in FIGS. 1–2, indicator 10 has upper surface 12 including a series of raised, or embossed, nodes 14 in which indicia 18 appear. Also included as part of indicator 10 are pin 22 and recesses 26 into which pin 30 may be inserted, as well as retainer button 34. Formed as part of retainer button 34 is protrusion or shaft 38, which projects above upper surface 12 for receipt by bore 42 of arm 46.

Indicator 10 additionally comprises lower surface 50 to which pressure sensitive or other adhesive 54 is applied. If necessary or desired, removable backing 58 may be included to cover adhesive 54 prior to use of indicator 10. As a result, indicator 10 need not be specially made to fit particular bottles or containers, but rather may be adhered to virtually any surface of them. Similarly, most bottles or containers with which indicator 10 may be used need not be altered or specially made. Disc-shaped embodiments of indicator 10 consistent with FIGS. 1–2, moreover, may be molded of plastic or other suitable material, providing an inexpensive, disposable alternative to the medicine minders discussed above.

As illustrated in FIG. 1, removing backing 58 exposes adhesive 54. With adhesive 54 uncovered, indicator 10 may be affixed to a particular container CO. When formed as a disc, the diameter of indicator 10 is usually approximately identical to that of a cylindrical cap CA used with common pill or medicine containers. Consequently, indicator 10 can be attached readily to the top T of cap CA merely by aligning lower surface 50 with top T and manually exerting force on upper surface 12. Alternatively, indicator 10 may be attached to a face or side S of container CO (as shown in phantom lines in FIG. 1) or at any other appropriate location. Because positioning of indicator 10 is not dependent on the shape or structure of container CO, it may be affixed to the container at any time and by any of the manufacturer, pharmacist, physician, or patient.

Typically (although not necessarily) after lower surface 50 is attached to container CO, pin 30 and arm 46 are connected to complete indicator 10. Placement of pin 30 is made to restrict travel of arm 46 commensurate with the patient's instructions respecting the medication in container CO. As illustrated in FIG. 2, pin 30 may be positioned in any of recesses 26A–D, each recess 26 corresponding to a node 14. The exemplary indicator 10 of FIG. 1 has pin 30 inserted into recess 26D, precluding arm from moving beyond the node 14 bearing the number "5" as indicia 18. If the patient's prescription requires five doses of medication per day, for example, pin 30 would likely be inserted into recess 26D. In this manner, indicator 10 inhibits the patient from taking a sixth dose by preventing further advancement of arm 46.

Pin 30 is shown in FIG. 1 as having a spherical lower portion 62 which may be forced into a recess 26, effectively making the pin 30 irremovable by a patient. Those skilled in the art will recognize, however, that pin 30 may be fixed in place when indicator 10 is formed or assume different shapes or that other mechanisms of limiting travel of arm 46 may be employed. By contrast, pin 22 often has a fixed position, preventing the patient from pivoting or rotating arm 46 outside its intended range of motion. Like pin 30, it too may be shaped, positioned, or otherwise structured in different ways.

Arm 46 includes first and second ends 66 and 70, respectively. Formed at first end 66 is annulus 74, designed to engage each of nodes 14 as appropriate and provide a positive, tactile fit that prevents arm 46 from moving unless manually manipulated. Second end 70 of arm 46, which includes bore 42, may be bifurcated as shown in FIGS. 1–2. In use, arm 46 may be friction fitted onto shaft 38, with bore 42 receiving the shaft. Shaft 38, therefore, serves as an axle about which arm 46 may pivot between pins 22 and 30.

Although detailed in FIGS. 1–2 as raised areas, nodes 14 need not be so formed, and instead may be either recessed or flush with upper surface 12. Nodes 14 similarly need not be shaped as circles or stubby cylinders, but rather may assume other shapes as desired. In these circumstances arm 46 may either omit annulus 74 or have such an annulus shaped other than as shown in FIGS. 1–2. Alternatively, first end 66 of arm 46 may terminate in a pointer or other means for designating one of indicia 18 at any given time or be sufficiently elongated to cover an indicia 18. Likewise, notwithstanding that numerals from "1" to "5" are illustrated as indicia 18 in FIGS. 1–2, other symbols may be used instead. Moreover, if nodes 14 are somehow distinguishable from upper surface 12 (as, for example, by being raised or recessed), indicia 18 may in some cases be omitted.

In a typical scenario envisioned by the applicant, a patient receives from his or her physician a prescription requiring "X" doses of a certain medicine per day. When filling the prescription, the patient's pharmacist will affix indicator 10 to the container CO enclosing the medicine. If, for example, "X" is three (thus requiring the patient to take three doses of the medicine per day), the pharmacist inserts pin 30 into recess 26B corresponding to the node 14 bearing the numeral "3" as indicia 18. The movement of arm 46, therefore, will be limited to nodes 14 bearing the numerals "1," "2," and "3" as indicia 18.

Prior to ingesting the initial dose of medicine from container CO, the patient moves arm 46 (if necessary) to ensure that annulus 74 engages node 14A, highlighting the numeral "1" appearing on that node. The patient then ingests the initial dose and immediately rotates arm 46 so that annulus 74 engages node 14B (highlighting the numeral "2"). In this position indicator 10 thus exhibits that the first dose has been taken and that the second dose is next to be ingested. After taking the second dose, the patient moves arm 46 so that annulus 74 engages node 14C (encircling the numeral "3"). After ingesting the third dose, however, the patient cannot advance arm 46, as such movement is precluded by pin 30. Indicator 10 thus informs the patient that no further doses are required for the day, reducing the possibility of accidental overdose.

Figure 4:
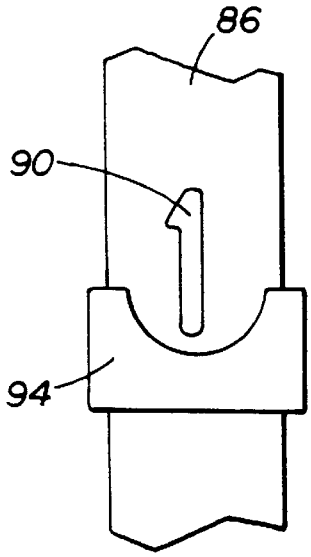
FIG. 4 is an enlarged view of a portion of the indicator of FIG. 3.
Figure 3:
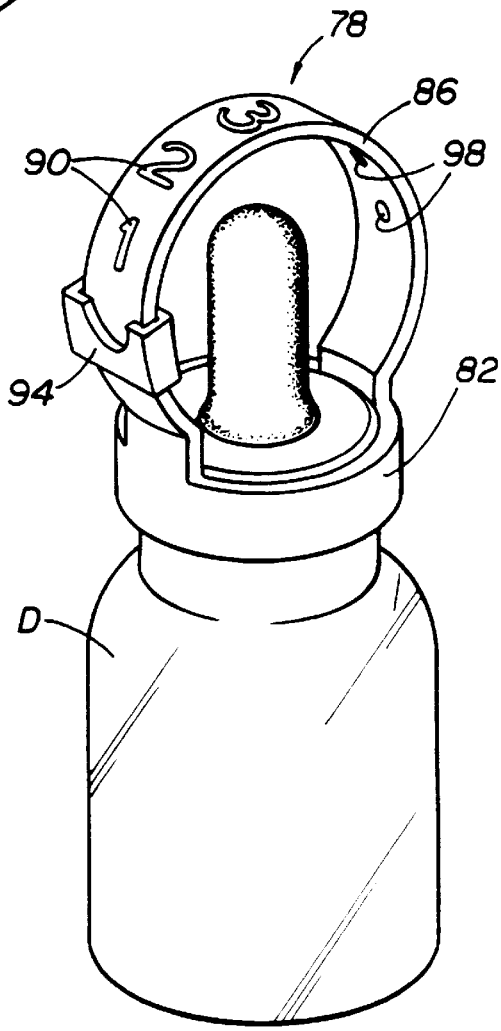
FIG. 3 is a perspective view of an alternate embodiment of the indicator of FIG. 1.

FIGS. 3–4 illustrate an alternative indicator 78 that may be used with dropper D or other containers having irregular surfaces. As shown in FIG. 3, indicator 78 includes a removable collar 82 that may be fitted about dropper D. Connected to collar 82 is arch 86, onto which indicia 90 may be printed or otherwise included. Fitted about arch 86 is arm or slide 94, which may be moved by the patient in a manner similar to the patient's movement of arm 46. Like indicator 10, arch 86 of indicator 78 may include a series of recesses 98 into which pins or other stops may be placed to restrict advancement of slide 94. Because collar 82 effectively limits movement of slide 94, it may function equivalently to pin 22 of indicator 10. In yet another embodiment for use with dropper D, the dropper may be fitted with a separate cap onto which indicator 10 is affixed.

The foregoing is provided for purposes of illustrating, explaining, and describing embodiments of the present invention. Modifications and adaptations to these embodiments will be apparent to those skilled in the art and may be made without departing from the scope or spirit of the invention. In particular, although the devices and method disclosed herein are primarily intended for use with medicine containers, their usage is not so limited, and they may be employed whenever indications such as they provide are desired.

I claim:

1. An indicator for attachment to the surface of a container comprising:

(a) an upper surface which defines a plurality of recesses and a plurality of indicia, each recess corresponding to one of the plurality of indicia;

(b) an arm having first and second ends;

(c) means for movably attaching the arm to the upper surface so that one of the first and second ends of the arm may be movably aligned to positions in registry with any selected one of the plurality of indicia;

(d) a lower surface;

(e) means, comprising an adhesive applied to the lower surface, for adhering the lower surface to the surface of the container; and (f) means, adapted to be inserted in any selected one of the plurality of recesses, for preventing the arm from being moved beyond the selected recess.

2. An indicator according to claim 1 in which the attaching means protrudes from the upper surface and about which the arm pivots.

3. An indicator according to claim 2 in which the adhering means further comprises a removable backing.

4. An indicator for attachment to a container comprising:

(a) an upper surface defining a plurality of recesses and a plurality of indicia, each recess corresponding to one of the plurality of indicia;

(b) an arm movably attached to the surface and having first and second ends; and (c) means, adapted to be inserted in any selected one of the plurality of recesses, for preventing one of the first and second ends of the arm from being moved beyond one of the plurality of indicia corresponding to a maximum dose prescribed in a designated interval.

5. An indicator according to claim 4 in which the movement-preventing means is a pin.

* * * * *